US005505175A

United States Patent [19]

Mai et al.

[11] Patent Number: 5,505,175

[45] Date of Patent: Apr. 9, 1996

[54] IGNITION SYSTEM FOR INTERNAL COMBUSTION ENGINE

[75] Inventors: Udo Mai, Untergriesbach; Ekkehard Kollmann, Passau; Johann Wandl, Untergriesbach, all of Germany

[73] Assignee: Vogt Electronic AG, Germany

[21] Appl. No.: 434,378

[22] Filed: May 3, 1995

[51] Int. Cl.[6] ..... F02P 5/00

[52] U.S. Cl. ..... 123/417; 123/598

[58] Field of Search ..... 123/417, 598, 123/604, 652, 594, 596, 618, 619, 626, 653

[56] References Cited

U.S. PATENT DOCUMENTS

| | | | |
|---|---|---|---|
| 3,945,362 | 3/1976 | Neuman et al. | 123/417 |
| 4,598,371 | 7/1986 | De Angelis et al. . | |
| 4,829,971 | 5/1989 | Minks | 123/598 |
| 5,074,274 | 12/1991 | Okuda | 123/604 |
| 5,131,377 | 7/1992 | Taruya et al. | 123/652 |
| 5,183,024 | 2/1993 | Morita et al. | 123/598 |
| 5,318,002 | 6/1994 | Okuda | 123/598 |

FOREIGN PATENT DOCUMENTS

| | | | |
|---|---|---|---|
| 0229643 | 7/1987 | European Pat. Off. | 123/417 |
| 0281528 | 9/1988 | European Pat. Off. | 123/417 |
| 0457383 | 11/1991 | European Pat. Off. | 123/417 |
| 3006019 | 8/1980 | Germany . | |
| 3714309 | 11/1988 | Germany . | |
| 3821740 | 1/1990 | Germany . | |
| 3928726 | 3/1991 | Germany | 123/417 |

OTHER PUBLICATIONS

Johnston et al, "Programmable Energy Ignition System for Engine Optimization," 1975 SAE Transactions, vol. 84, No. 2, pp. 847–855.

*Primary Examiner*—Raymond A. Nelli
*Attorney, Agent, or Firm*—Dominik & Stein

[57] ABSTRACT

An alternating current based ignition system, in which a computer, in which a motorspecific data recognition field ("look-up" table) is stored and which is provided by sensors with operating parameters, controls the duration of the alternating ignition current and the ignition coil energy.

12 Claims, 3 Drawing Sheets

IGNITION SYSTEM FOR INTERNAL COMBUSTION ENGINE

BACKGROUND OF THE INVENTION

1. Field of the Invention

The present invention concerns an ignition system for an internal combustion engine, and more particularly, an alternating current based ignition system in which a computer, in which a motor-specific data recognition field ("look-up" table) is stored and which is provided by sensors with operating parameters, controls the duration of the alternating ignition current and the ignition coil energy.

2. Description of the Related Art

Ignition systems using alternating current ignition are known as exemplified by DE 39 28 726. In order to adapt the ignition system to the various load conditions of the internal combustion engine, the firing time of the high frequency alternating ignition current can be altered to effect the bum time of the ignition spark. With this known type of ignition system, the spark current amplitude is constant during the firing time. The amplitude must be selected to be of sufficient magnitude, such that under all load conditions of the motor a guaranteed ignition is insured. The effective voltage amplitude necessary for ignition under various load conditions of the internal combustion engine varies greatly. This means that, as a rule, the energy supplied for the ignition in known systems is too large. This increases sparkplug wear and increases electricity usage during the starting and running of the motor.

It is an objective of the present invention to provide an alternating current based ignition system for internal combustion engines, which operates more efficiently under changing operating conditions.

SUMMARY OF THE INVENTION

These and other objects of the invention are accomplished by the ignition system for internal combustion engines according to the present invention comprising in combination: a DC supply, an ignition coil having primary and secondary windings, the primary winding being electrically coupled in series to a controllable switching transistor and to the output of the constant voltage supply and the secondary winding being electrically coupled to electrodes of a sparkplug; an oscillating capacitor and an energy recovery diode, the energy recovery diode being provided in series with the primary winding and in parallel with the output of the controllable switching transistor, the oscillating capacitor being provided in parallel with the controllable switching transistor or in parallel with the primary winding, whereby an alternating current is produced; and a computer for controlling the switching transistor, the computer facilitating the storing of a motor-specific data recognition field and the receiving of measured values associated with the motor operating parameters via sensors, the computer, under control of the data recognition field, producing an impulse which is determinative of the duration of the ignition alternating current as well as producing a signal which controls the switched condition of the switching transistors which resultingly produces the ignition coil energy controlling signal.

The principal idea of the invention resides in controlling both the duration of the alternating ignition current and the ignition coil energy by way of a computer taking into account (a) motor-specific recognition characteristics which are stored in the computer ("look-up tables) and (b) the operating parameters of the motor as measured with sensors, and thereby to optimize the energy utilization. This additional controlling of the ignition coil energy is possible because the computer provides not only one output, but two outputs. Furthermore, the circuit of the present invention comprises an oscillating capacitor as well as an energy recovery diode.

The foregoing has outlined rather broadly the more pertinent and important features of the present invention in order that the detailed description of the invention that follows may be better understood and so that the present contribution to the art can be more fully appreciated. Various circuits as well as specific embodiments of this circuitry for realizing the inventive solution according to the invention will be described hereinafter and form the subject of the claims of the invention. It should be appreciated by those skilled in the art that the conception and the specific embodiments disclosed may be readily utilized as a basis for modifying or designing other ignition systems for an internal combustion engines for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the present invention reference should be made by the following detailed description taken with the accompanying drawings in which there is shown.

DETAILED DESCRIPTION OF THE INVENTION

In accordance with a first essential characteristic of the invention there is provided in all circuits a computer 1, in the memory of which motor specific data with respect to the necessary ignition voltage and current is stored in the form of a family of characteristics. This is sometimes referred to in the art as "look-up tables". In accordance therewith, for example, the necessary ignition voltage is attenuated with increasing RPM, but is increased however with increasing load.

The ignition voltage and the ignition current are then controlled in accordance with this family of characteristics and with the measured values as determined by sensor 2, which correspond to actual operating parameters.

As is known, energy E which is stored in the inner coil having inductance L at a current flow I is determined using the following formula:

$$E=\tfrac{1}{2}L*I^2$$

Since the inductance L of the ignition coil of an ignition system is not variable, only the current I can be varied for the control of energy. For the current the following equation controls:

$I=U*t/L$

The ignition system driving voltage U which is taken from the electrical circuit of the automobile should, for technical reasons, be maintained constant so that the only control variable remaining for changing of the stored energy is the voltage running duration t. This is changed by variation of the on-time of a switch-on transistor which is provided in the ignition coil circuit, namely, the IGBT-transistor 12 in the embodiment of the invention according to FIGS. 1–3. The longer the IGBT-transistor is switched on, the greater will be the current flowing through ignition coil 10 and the greater its stored energy E will be, which determines the current and ignition voltage amplitude that will be delivered to the spark plugs.

Figure 1:
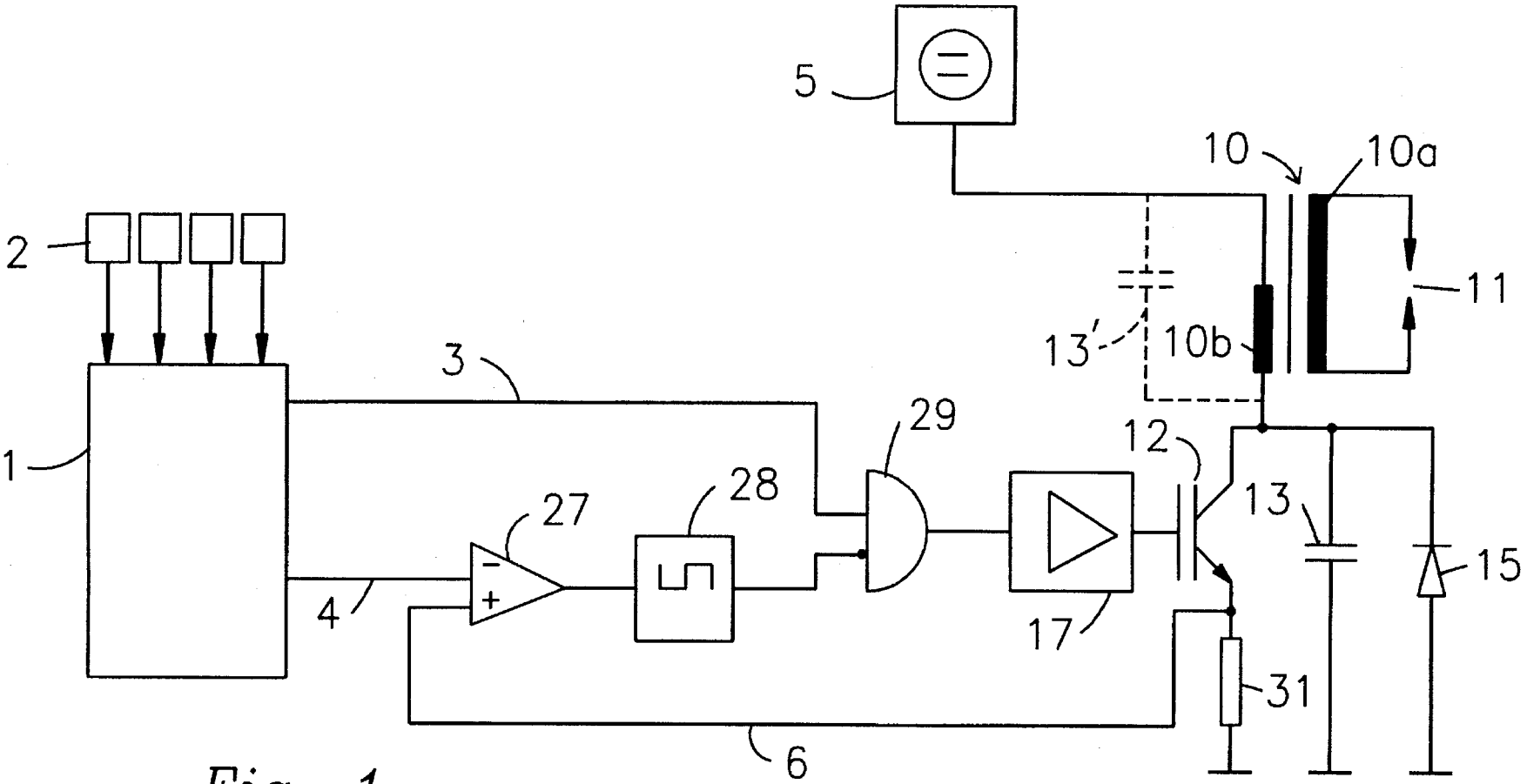
FIG. 1: A block circuit diagram of a circuitry according to the invention for ignition current control according to a first embodiment of the invention.
Figure 2:
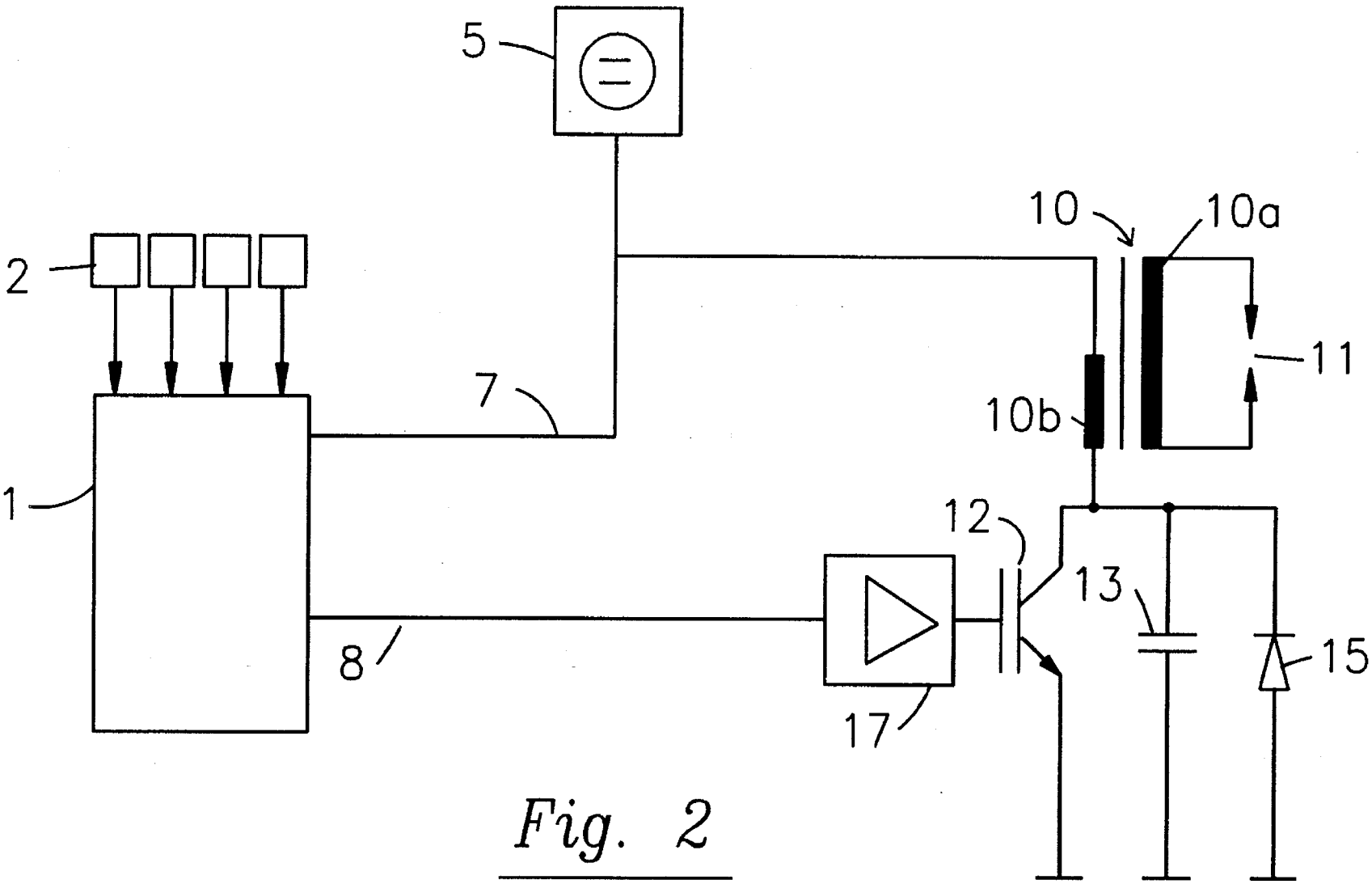
FIG. 2: a block circuit diagram of a circuitry according to a second embodiment of the invention.
Figure 3:
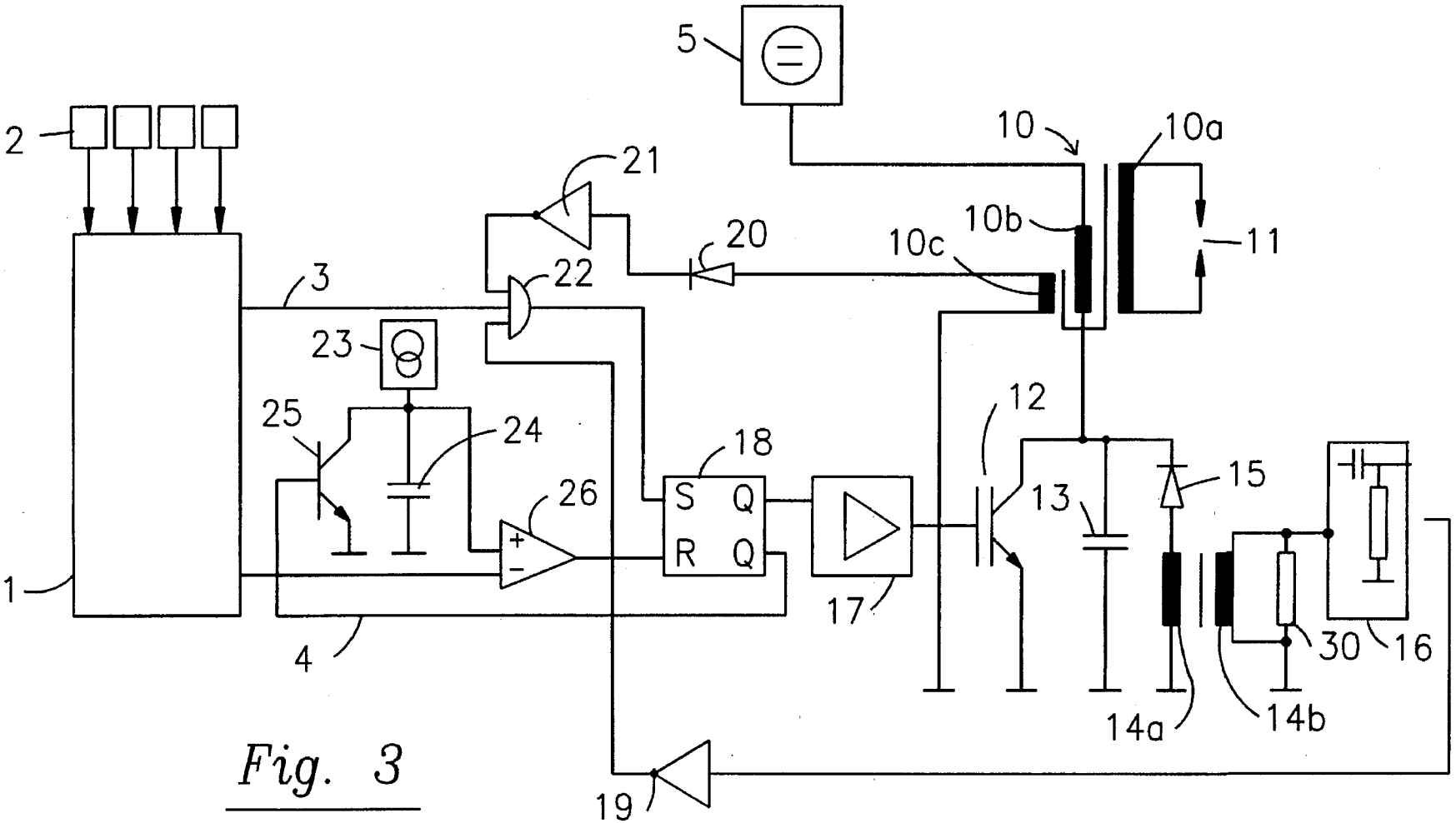
FIG. 3: a block circuit diagram of a circuitry according to a third embodiment of the invention.

In all circuits according to FIGS. 1–3, the control is achieved, as discussed above, by way of the computer 1, where outputs 3 and 4, or as the case may be, 8, provide control signals for controlling the IGBT-transistor 12 thereby determining the duration of the alternating ignition current and the supplied ignition coil energy. The operating frequency is preferably in the range of 8 kHz to 17 kHz, but can, however, with appropriate circuitry also be extended down to approximately 100 Hz as well as be extended up into the MHZ range.

Individually these circuits have the following construction and manner of functioning.

In the circuit according to FIG. 1 the output 3 of the computer 1 is electrically coupled to the control input of the IGBT-transistor 12 via a first input of an AND-gate 29 and the after-switched drive step 17. The output 3 provides an impulse which determines the dwell time or duration of the alternating ignition current.

The second output 4, which provides a signal to control the ignition coil energy, is electrically coupled to a first input, the (–) input, of a comparator 27, of which the output is electrically coupled via a monoflop 28 to the second input of the AND-gate 29.

The switching transistor, preferably, the IGBT-transistor 12, is connected in the electrical path of the primary winding **10*b* of the ignition coil 10 and the voltage supply 5. The ignition sparkplug 11, with its symbolically indicated electrode, is connected to the secondary winding 10*a* of the ignition coil 10. Parallel to the output of the switching transistor 12, in essence being parallel to the collector-emitter section of the switching transistor 12, an oscillating capacitor 13 and an energy recovery diode 15 are electrically coupled. In the operational electrical circuit model of the IGBT-transistor 12, specifically between the emitter and ground, there is provided an ohmic resistor 31. The voltage drop of the resistor 31, which is proportional to the ignition coil current, is supplied to the second input, namely the (+) input, of the comparator 27. Instead of correcting the oscillating capacitor 13 in parallel to the energy recovery diode 15, it is possible to connect it in parallel to the primary winding 10*b* as illustrated with dotted lines in FIG. 1**.

This circuit operates as follows. By way of the ignition spark duration signal provided by the output 3 of the computer 1, which runs, when the AND-gate 28 is open, being electrically coupled over to the driving stage 17 and the base of the IGBT-transistors, the current of the primary winding **10*b* of the ignition coil 10 thereby increases linearly. Being proportional to this current of the primary winding 10*b* the voltage at the emitter resistor 31 is electrically coupled by way of the circuit 6 to the (+) input of the comparator 27. As long as the voltage at the (+) input is less than the energy control voltage provided by the output 4 of the computer at the (–) input, the output of the comparator 27, by way of the monoflop 28, will control the AND-gate 29 so as to remain open. If however the voltage at the (+) input of the comparator 27 exceeds the voltage at the (–) input, the output of the comparator becomes positive and triggers the monoflop 28 which closes the AND-gate 29 for the duration of its generated impulses. The IGBT-transistor transistor 12, as a result, is turned off. The stored energy in the ignition coil 10 thereby produces a half sine voltage at the capacitor 13 which, after being transformed at the secondary winding 10*a*, is the ignition voltage for the sparkplug 11. The surplus energy is returned to the power supply 5 via the energy recovery diode 15. The duration of the impulse supplied by the monoflop 28 is such that the transistor 12 is definitely turned off during the duration of the half-sinusoidal shaped voltage at the capacitor 13. The pulse of the monoflop 28 ends during the current discharge time of the energy recovery diode 15. If the current through this diode 15 becomes zero, then the current begins to flow through the transistor 12, until such time as the dropping voltage at the resistor 31 again corresponds to the energy control voltage of output 4 of the computer 1. This process repeats itself so long as the output 3 of the computer 1** supplies the ignition spark duration determining impulse.

Alternatively, an apparently less complicated circuitry design according to FIG. 2 operates in a similar manner as described above for the circuit depicted in FIG. 1. In FIG. 2, the switching according is simplified in comparison to that shown in FIG. 1 because the functions of the comparator 27, the monoflop 28 and the AND-gate 29 are replaced by calculations in the computer 1. As has already been discussed above by way of introduction, the inventive concept is having the energy stored in the coil being varied due to modifying the energizing time of the transistor 12. After turning off the transistor 12 for the predetermined time, the switching transistor is again switched back on, that is, to open during the switching. According to FIG. 1, this is performed by the monoflop 28. For the switching of the transistor 12 according to FIG. 2, the predetermined switching off time is set by the computer. The remainder of the operation of the switching according to FIG. 2 corresponds to the operation of the circuit depicted in FIG. 1. As long as the voltage source 5 supplies a constant voltage, the electrical connection 7 shown in FIG. 2 is not required. Should, however, no constant drive voltage be available, the drive voltage value is to be input into the computer 1 as a further operating parameter and supplied via electrical connection 7.

In FIG. 3, a further discrete component constructed control circuit according to the invention is shown. Similar to the circuitry according to FIG. 1, this circuitry includes a control output 3 from the computer 1 that electrically connects to an input of an AND-gate 22.

The output of the AND-gate 22 is electrically coupled with a first input, the S-input of an RS-flip-flop 18.

The second control output 4 of the computer 1 is electrically connected to the (–) input of a comparator 26, the output of which is then electrically connected to the R-input of the RS flip-flop 18. The Q-output of the RS-flip-flop 18 controls, with the aid of a driver step 17, the IGBT-transistor 12. Electrically coupled to the voltage source 5 is the spliced primary winding **10*b* about which the ignition coil 10 is positioned. As in the circuitry according to FIGS. 1 and 2, the sparkplug 11 is electrically coupled with its electrode on the secondary winding 10*a* of the ignition coil 10. The providing of the swing circuit condensers 13 and the energy recovery diodes 15 corresponds to that of the circuit according to FIG. 1. However, being different from the operation of the circuit in FIG. 1, the signal, after being differentiated by the differentiating circuitry and converted by way of the inverter 19, carried by the current which flows through the diode 15 by way of a current converter 14 is supplied to the second input of the AND-gate 22. In the circuit according to FIG. 3, the current converter 14 is comprised of a uniform transformer which includes a primary winding 14***a* that is electrically coupled to the energy recovery diode 15 and a secondary winding 14*b* that is electrically coupled to an ohmic resistor 30.

The third input of the AND-gate 22 is supplied with a loaded or complex signal that is tapped out of the current induced in the ignition coil 10. For this purpose there is on the primary winding 10*b*, the ignition coil 10, a secondary winding 10*a*, and a third winding 10*c* that are collectively inductively coupled so that the ignition current thereby induces a control current which is then rectified by way of a rectifier 20 and inverted by way of an inverter 21 before being supplied to the third input of the AND-gate 22.

While in the circuit according to FIG. 1 the second input of the comparator 26 is supplied the tapped off linearly increasing voltage that is dropped across the ohmic resistor 31, the circuit according to FIG. 3 is served for this purpose by an independent voltage source that is supplied the (–) input of the comparator 26. The independent current source comprises a capacitor 24 at its output and this capacitor is bridged over by a switching transistor 25 which is controlled by the Q-bar-output of the flip-flop 18. If the switching transistor 25 is off, then the capacitor 24 that is electrically coupled to the (+) input of the comparator 26 can load itself linearly. Once this voltage reaches the threshold according to the preset voltage value at the output 4 of the computer 1, then the comparator 26 produces on its output, which is electrically coupled to the R-input of the flip-flop 18, a corresponding signal which switches the flip-flop 18.

With this as a introduction, the following is the mode of functioning of the circuit according to FIG. 3.

From the signal supplied to the output 3 of the computer 1, the ignition spark duration determining impulse controls are provided via the AND-gate 22 and the RS flip-flop 18, as long as, however, the two additional inputs of the AND-gate 22 are also positive. The IGBT-transistor 12 is then switched on due to the now positive Q-output of flip-flop 18 aided by the driver step 17. At the same time, if the switch transistor 25 is turned on, capacitor 24 produces a linear increasing voltage U1 at the (+) input of the comparator 26. This linear voltage U1 is compared to the control voltage supplied by the energy control circuitry in the computer 1 via the output 4. If the linear voltage U1 exceeds the control voltage, the voltage at the output of comparator 26 is positive whereby the flip-flop 18 is reset back again. Hence, the IGBT-transistor 12 is blocked, and as already described above, the ignition voltage is produced. Since during the duration of the half sinusoidal voltage on the capacitor 13 and the conducting time of the energy recovery diode 15, the capacitor 24 should not be loaded and the switch transistor 25 must be switched over. For this purpose signals are supplied to the AND-gate 22 at one input via the third winding 10*c*, the diode 20 and the inverter 21 and at the other input side via the current converter 14, the differentiating circuitry 16 and the inverter 19 which serves to disable the AND-gate 22. As a result, the flip-flop 18 cannot be set such that the transistor 25 switches over, i.e., conducting remains and the loading of the capacitor 24 is prevented. If both the processes have run out, then the AND-gate 22 is again enabled, the flip-flop 18 is set and the cycle is repeated from anew.

By the above-described process the ignition current is achieved and the sparkplug life is increased.

Above and beyond this, the ignition energy control results in an increase in the lifespan of the catalytic converter. Since, as is known, gasoline destroys the catalytic converter, the egress of gasoline must be prevented. In order to achieve this, the computer 1 is provided with a signal by way of a sensor 2. Such sensors 2 can, for example, be knock sensors or movement sensors, which sense the differential movement angle of the crank shaft.

At the beginning of each ignition, there is by way of the computer 1, a set of preset beginning parameters and a specific predetermined ignition energy. If a detonation or, as the case may be, a sparking is detected, then the ignition process can immediately be arrested. If, however, after a predetermined time no detonation is determined, the computer 1 permits the ignition energy to continuously increase until ignition occurs. If no ignition is detected within the predetermined ignition period, the ignition energy can be adjusted to the maximum value and the ignition sustained up until the next top dead center. By these measures, it is accomplished that a large as possible portion of the gas-air-mixture available in the cylinder space is combusted, which results in a maximal catalytic converter life.

If a number of failed ignitions occur within a predetermined internal, then the gas injection for the specific cylinder can be interrupted by the computer 1 and an alarm signal for the automobile driver can be set off.

The concept according to the invention for the ignition energy controlling in dependence upon a recognition field and from measured operating parameters in combination with an ignition sensor which monitors the ignition process senses or determines, results in an optimization of the ignition sparkplug protection and catalytic converter lifespan.

Although this invention has been described in its preferred form with a certain degree of particularity with respect to a an alternating current based ignition system in which a computer, in which a motor-specific data recognition field ("look-up table) is stored and which is provided by sensors with operating parameters, controls the duration of the alternating ignition current and the ignition coil energy, it is understood that the present disclosure of the preferred form has been made only by way of example and that numerous changes in the details of structures and the composition of the combination may be resorted to without departing from the spirit and scope of the invention.

Now that the invention has been described,

What is claimed is:

1. An ignition system for internal combustion engines comprising in combination:

a DC supply (5), an ignition coil (10) having primary and secondary windings (10*b*, 10*a*), said primary winding (10*b*) being electrically coupled to a controllable switching transistor (12) at the output of said constant voltage supply (5) and said secondary winding (10*a*) being electrically coupled to electrodes of a sparkplug (11);

an oscillating capacitor (13) and an energy recovery diode (15), said energy recovery diode (15) being provided in series with the primary winding (10*b*) and in parallel with the output of said controllable switching transistor (12), said oscillating capacitor being provided in parallel with said controllable switching transistor or in parallel with said primary winding whereby an alternating current is produced; and a computer (1) for controlling the switching transistor (12), said computer (1) facilitating the storing of a motor-specific data recognition field and the receiving of measured values associated with the motor operating parameters via sensors (2), said computer (1), under control of the data recognition field, producing a signal which is determinative of the duration of the ignition alternating current as well as producing a signal which controls the switched condition of the switching transistors (12) which resultingly produces the ignition coil energy controlling signal.

2. The ignition system as recited in claim 1, wherein said impulse is provided to a first input of an AND-gate (29) and said ignition coil energy controlling signal is provided to a second input of said AND-gate (29), whereby the output, by way of a driver step (17), controls the switching transistor (12).

3. The ignition system as recited in claim 2, wherein said ignition coil energy controlling signal is provided to a (–) input of a comparator (27), and said switching transistor (12) includes a resistance (31) that is electrically coupled to the emitter thereof so as to provide an ignition coil current proportional voltage which is provided the (+) input of the comparator (27), wherein the output of said comparator (27) by way of a monoflop (28) is electrically coupled with said second input of said AND-gate (29).

4. The ignition system as recited in claim 1, wherein the output of the computer (1) by way of a driver step (17) immediately controls the switching transistor (12), said computer (1) determining the varying on-time duration of the switching transistor (12) in the computer (1) by way of considering the actual operating parameters and corresponding measured values, said computer (1) determining the constant off-time duration of the switching transistor (12 ), whereby in varying the on-time duration of the switching transistor (12) a stored energy is produced in the ignition coil (10) and associated therewith is a high frequency ignition alternating current having a varying amplitude and duration.

5. The ignition system as recited in claim 4, wherein said computer (1) provides a constant voltage supply in the form of a further operating parameter.

6. The ignition system as recited in claim 1, wherein said current controlling impulse is provided to the first input (S) of a flip-flop (18), the Q-output therefrom is by way of a driver step (17) electrically coupled to said switching transistor (12), said ignition coil energy controlling voltage being provided to the (–) input of a comparator (26) from said computer (1), the (+) input of said comparator (26) being electrically coupled with a controllable constant voltage source (23, 24, 25) which is supplied a linearly increasing direct voltage, said comparator (26) having an output that is electrically coupled to the (R) input of said flip-flop (18), a Q-output of the flip-flop (18) thereby providing a signal which facilitates the resetting of the controllable constant voltage source (23, 24, 25).

7. The ignition system as recited in claim 6, wherein said controllable constant voltage source is further comprised of a direct current power supply (23), a capacitor (24) electrically coupled to the output of said power supply (23), said power supply being bridged over by a switching transistor (25) and electrically coupled to the Q-output of said flip-flop (18).

8. The ignition system as recited in claim 7, wherein said current controlling impulse is supplied by said computer (1) to said S-input of said flip-flop (18) by way of an AND-gate (22), said AND-date (22) being blocked during the ignition process.

9. The ignition system as recited in claim 8, wherein said primary winding (10*b*) of said ignition coil (10) further includes a third winding (10*c*) for inductively coupling the ignition voltage corresponding signal which is then rectified by way of a diode (20) and inverted by way of an inverter (21) to the second input of the AND-gate (22).

10. The ignition system as recited in claim 9, wherein said ignition coil (10) supplies a voltage to an energy recovery diode (15), the output of said recovery diode (15) is electrically coupled to a third input of said AND-gate (22).

11. The ignition system as recited in claim 10, wherein current generated by said energy recovery diode (15) is converted by a current converter (14*a*, 14*b*, 30) to a voltage which by way of differentiating circuitry (16) and an inverter (19) is electrically coupled to the third input of the AND-gate (22).

12. The ignition system as recited in claim 11, wherein said current converter is further comprised of a transformer having a primary winding (14*a*) electrically coupled in series to said energy recovery diode (15) and a secondary winding (14*b*) electrically coupled in parallel to an ohmic resistor (30).

* * * * *